US006660919B2

(12) United States Patent
Lim

(10) Patent No.: US 6,660,919 B2
(45) Date of Patent: Dec. 9, 2003

(54) REGULATOR FOR THE CONTROLS THE TIMBRE AND THE VOLUME OF FLUTE SOUND

(76) Inventor: Jae-Dong Lim, 4F Hyosung B/D, 1695-7, Seocho-4dong, Seocho-ku, Seoul 137-074 (KR)

( * ) Notice: Subject to any disclaimer, the term of this patent is extended or adjusted under 35 U.S.C. 154(b) by 0 days.

(21) Appl. No.: 10/009,994

(22) PCT Filed: Dec. 12, 2000

(86) PCT No.: PCT/KR00/01438

§ 371 (c)(1),
(2), (4) Date: Apr. 18, 2002

(87) PCT Pub. No.: WO01/80217

PCT Pub. Date: Oct. 25, 2001

(65) Prior Publication Data

US 2002/0178892 A1 Dec. 5, 2002

(30) Foreign Application Priority Data

Apr. 17, 2000 (KR) ..... 2000-20135

(51) Int. Cl.[7] ..... G10D 7/02
(52) U.S. Cl. ..... 84/384; 84/386; 84/380 R
(58) Field of Search ..... 84/384, 386, 380 R, 84/382, 383 R

(56) References Cited

U.S. PATENT DOCUMENTS 1,376,004 A * 4/1921 Christensen ..... 84/384
3,454,703 A * 7/1969 Rose ..... 84/723
3,487,742 A * 1/1970 Mills ..... 84/384
4,240,320 A * 12/1980 Pellerite ..... 84/384
4,499,810 A * 2/1985 Ferron ..... 84/384
4,672,878 A * 6/1987 Senior ..... 84/384

* cited by examiner

*Primary Examiner*—Shih-Yung Hsieh
(74) *Attorney, Agent, or Firm*—Shinjyu Global IP Counselors, LLP

(57) ABSTRACT

This invention is of a mechanism which controls the timbre and the volume of flute sound. More concrete explanation of the device is as follows. This device enables the players to control the various color and the volume of the sound and perform with unique tone regardless to what material each flute is made up of. A blocking piece is positioned behind the cork of the head joint which forms a flute along with the body and the foot joint, and a connecting piece is installed on the control cap in a spiral assembly. The oscillation wave caused by the air pressure inserted through the mouthpiece of the head joint goes through the cork and is transferred to the blocking piece and the connecting piece with different weights reflecting some part of the wave and absolving the other at the same time. Thus this wave will change into different oscillating waves which makes the variety of tone color and volume possible, the most characteristic point this mechanism serves for.

18 Claims, 2 Drawing Sheets

REGULATOR FOR THE CONTROLS THE TIMBRE AND THE VOLUME OF FLUTE SOUND

This application is the national phase application under 35 U.S.C. §371 of prior PCT International Application No. PCT/KR00/01438 filed on Dec. 12, 2000 and published in the English language on Oct. 25, 2001.

TECHNICAL FIELD

This invention is of a mechanism which controls the timbre and the volume of flute sound. More concrete explanation of the device is as follows. This device enables the players to control the various color and the volume of the sound and perform with unique tone regardless to what material each flute is made up of.

BACKGROUND ART

The flute, one of the woodwind instruments, has even tone in all ranges, and the basic tone made by its unique oscillation gives the impression of spreading smoke. Since the amount of breath and the fortitude of the vibration is controlled by the player's lips themselves, the player has the most significant effect on the characteristics of the sound. The player can also contribute to a more lively sound with vigor or to more delicate and supple sound with emotion. Such advantages of the flute have attracted attentions of music lovers not only in the past but also today.

Flutes can be distinguished into French open key flutes and German covered key flutes depending on whether the key over the tone hole is open or not. They used be made of wood in the beginning but today, they are made of metal and covered with nickel or silver. Some players have some part of their flutes made in silver, or the whole instrument in silver, gold or platinum.

The constitution of the flute can be simply stated as follows. There is a head joint with a head screw which controls volume and the mouthpiece which lets the air in, the body joint with holes that control pitch and the foot joint. Described here is a head joint with head screw which enables the control of volume.

FIG. 3 is a sectional drawing of essential parts showing the volume-control mechanism of the head joint former flutes. It shows that on the outside, there is a mouthpiece formed to let air in. In the inside, the control cap where the end of the spiral staff is screwed, and the operating part with a cork which prevents the air from escaping through the metal pieces where the spiral staff crosses are arranged inside the head joint.

According to the drawing, certain amount of space is formed between the operating part and the control cap.

In earlier flutes, the volume is controlled by the revolution of the control cap(54) which spins the screwed on spiral staff(502). This changes the distance of the metal piece (504)(a part of the operating part(500)) and the cork(506), altering, at the same time, the distance with the mouthpiece (52). Thus difference in the pressure of the air inserted through the mouthpiece(52) can regulate the pitch and the volume of a tone.

The further the operating part(500) is from the mouthpiece(52) the higher the pitch and the closer, the lower. At this point, if the mouthpiece(52) and the operating part(500) is kept 17 mm apart, then the high pitch and the low pitch can ring with good balance altogether, which is why most flutes are set this way.

But in the head joint of these earlier flutes, the pitch and the volume can be controlled only by the change of air pressure between the mouthpiece and the operating part producing a fixed sound which prevented players from performing with certain character of their own.

Also flutes made up of nickel, silver, gold or platinum, all have different tonality from each other. Therefore professional players have the inconvenience of using hand made flutes of silver, gold or platinum which has even tone yet and an expensive price.

DISCLOSURE OF INVENTION

Thus, this mechanism was developed to relieve such problems of the earlier flutes and to help the players perform with characterized tone by allowing tone color and volume to be controlled independent from the materials of which each instrument is made.

Controlling the tone color and volume will also enable players to give outstanding performances without expensive flutes which would achieve the other purpose of this invention.

In order to accomplish these purposes, this specific mechanism is installed to the head joint of the flute which forms the flute along with the body joint and the foot joint. A blocking piece is positioned behind the cork of the head joint and a connecting piece is screwed on to the installed control cap in a spiral assembly. The oscillation wave caused by the air pressure inserted through the mouthpiece of the head joint goes through the cork and is transferred to the blocking piece and the connecting piece with different weights reflecting some part of the wave and absorbing the other at the sane time. Thus this wave will change into different oscillating waves, which makes the variety of tone color and volume possible. To achieve the above, the mechanism is formed of two parts in the head joint; blocking piece with a certain thickness screwed on to a spiral staff behind the cork-lined up through the screw holes under the spiral staff-and the connecting part attached to the top control cap by the projected screw attachment-the screw attachment and the control cap lined up is the spiral attachment. It is also characteristic that there is an ornament on the outer side of the control cap.

Figure 1:
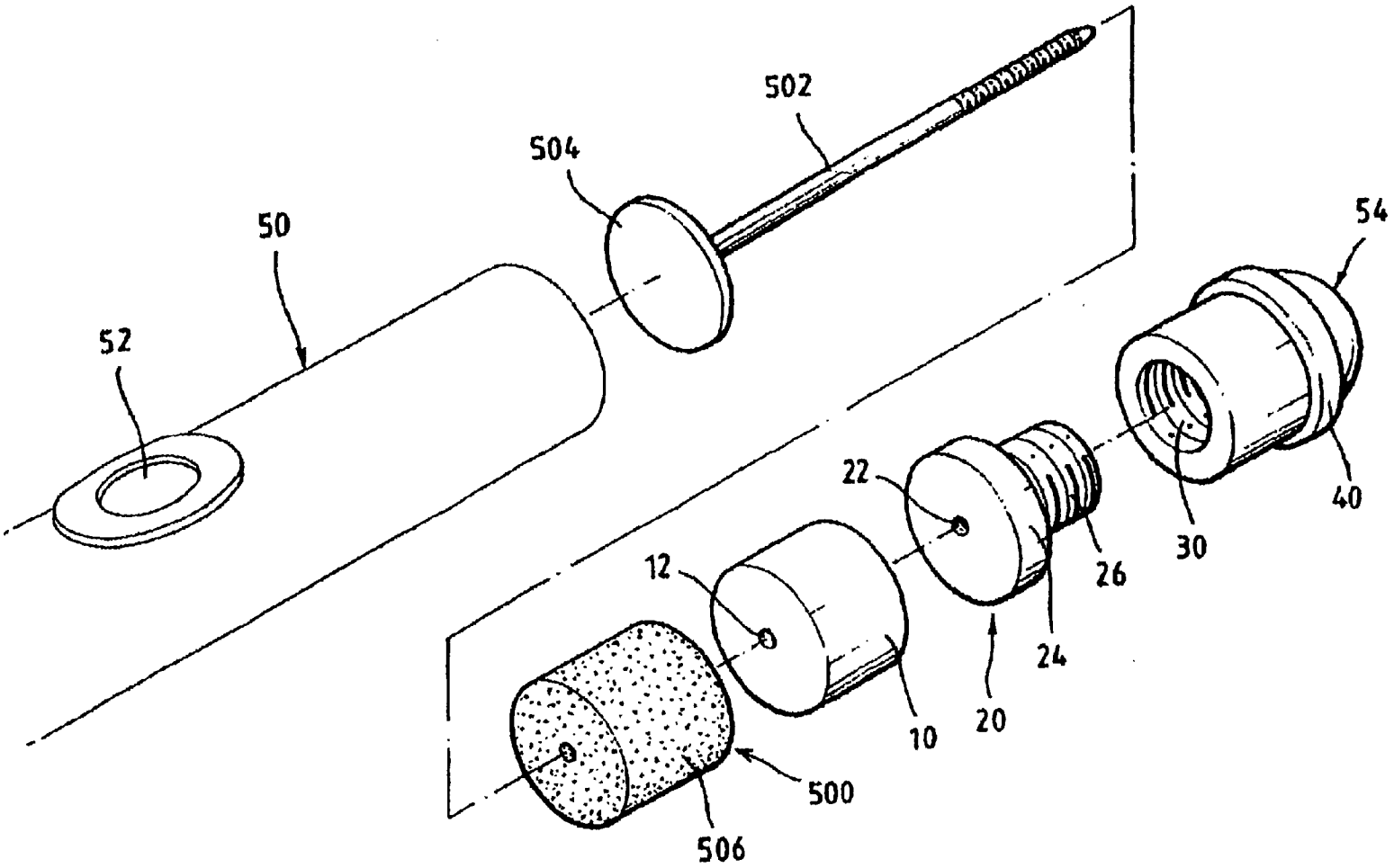
FIG. 1—Perspective drawing of essential parts disassembled showing the construction of the mechanism.

| Key to the numbered parts | | |
|---|---|---|
| 10: Blocking Piece (Button) | 12: Connecting Hole | 20: Connecting Piece (Button) |
| 22: Screw | 24: Blocking Part | 26: Screw Attachment |
| 30: Screw Hole | 40: Ornament | 50: Head Joint |
| 52: Mouth piece | 54: Control Cap | |
| 500: Operating Part | 502: Spiral Staff | |
| 503: Metal Plate | 506: Cork | |

BEST MODE FOR CARRYING OUT THE INVENTION

Referring to the drawings of the proper assembly of the mechanism, the concrete construction of the Mechanism is as follows.

Figure 2:
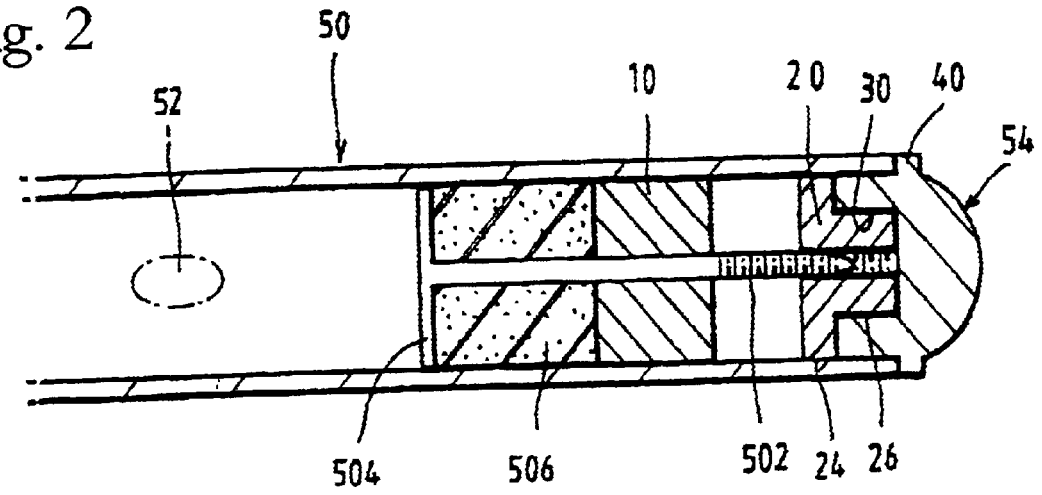
FIG. 2—Sectional drawing of essential parts showing the mechanism fully constructed according to FIG. 1.
Figure 3:
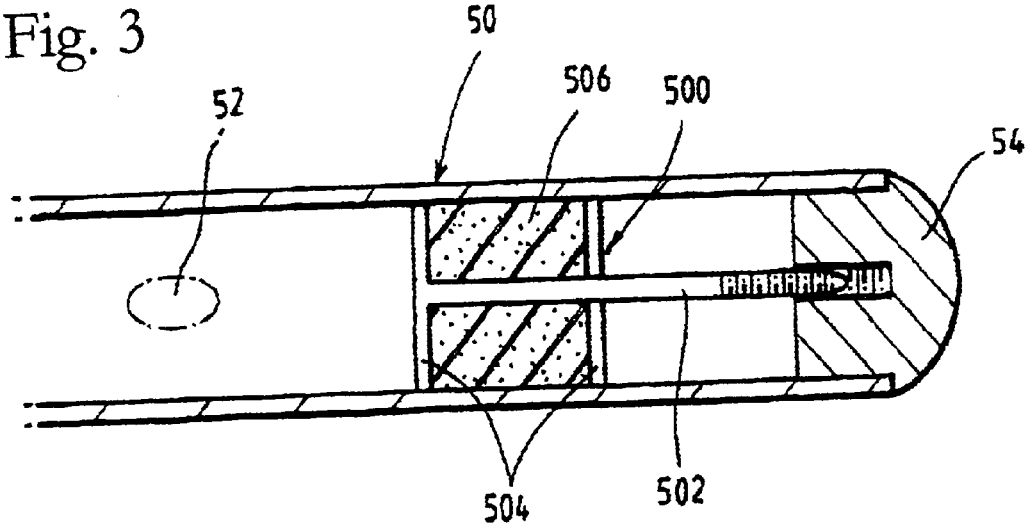
FIG. 3—Sectional drawing of essential parts displaying the volume control mechanism of former flutes.

FIG. 1 is a perspective drawing of the disassembled parts showing the construction of this mechanism and FIG. 2 is the sectional drawing of the these parts when assembled.

In most flutes, there is the mouthpiece(52) on the outer side of the head joint and the operating part(500) formed of metal plate(504) and cork(506) installed on the spiral staff (502) along with the control cap(54). In this mechanism, there is a blocking piece(10) of a fixed thickness which connects to the spiral staff(502) through the connection hole-lined up through the screw hole and screwed to the spiral staff(502) and on the control cap, there is a screw hole for the projected screw attachment to be attached firmly.

Outside the control cap mentioned above, an ornamental part of some width can be fixed in a traditional way for stones like zircon to be attached. It would also be quite appropriate, to sculpt a pattern or a shape to enhance the beauty of the instrument.

More concrete description of the enactment of the mechanism is as follows.

As explained above, behind the cork(506) attached to the spiral staff(502), a blocking piece(10) of a certain thickness is affixed forming the blocking part(24).

This is then attached to the control cap formed of connecting piece. The spiral staff is screwed through the hole on the connecting piece. As the blocking piece(10) and the connecting piece(20) are connected, air is inserted through the mouthpiece of the head joint. The wave produced from the change in the air pressure is passed through the metal plate(504) and the cork(506) to the blocking piece(10) behind. At this point when the wave is passed to the blocking piece (10), some is reflected and some absorbed changing the tonality. Since tone of the note can be liberally changed depending on the thickness of the blocking piece(10), each player can exchange the blocking piece according to his or her own taste. This is how a player can perform with his or her own tonality making possible the variety of performances by various players.

The blocking pieces(10) of different thickness will not only control the tone color but also control the volume, for the wave reflected or absorbed by the blocking piece(10) (enabled by the blocking part(24) of the connecting piece (20) fixed to the control cap(54)) will changed the oscillation. If the player wishes to turn up the volume, the control cap(54) can be turned to change the distance between the blocking piece(10) and the connecting part(24) of the connecting piece(20). The change of the oscillation will follow enabling the control of the volume.

Therefore, when the volume needs to be controlled, blocking part(24) of the connecting piece(20) with different thickness can be selected according to the player.

On the top of the control cap is a place where stones like zircon and other ornaments can be placed by traditional methods. Original decorations can also be used or a pattern can be sculpted right on to the ornament area(4) itself in the process of producing a control cap(54).

What is claimed is:

1. A method of volume and tone control comprising:

positioning a blocking piece between a cork of a head joint of a flute and a distal end of said head joint: and installing a connecting piece between said blocking piece and a control cap being positioned on said distal end of said head joint.

2. The method of volume and tone control according to claim 1 further comprising installing said connecting piece to connect to said control cap by screwing said connecting piece into a threaded hole formed in said control cap, said connecting piece and said control gap forming a spiral assembly.

3. The method of volume and tone control according to claim 2 further comprising selecting said cork to allow an oscillation wave caused by air pressure inserted through a mouthpiece of said head joint to pass through said cork and be transferred to said blocking piece and said connecting piece.

4. The method of volume and tone control according to claim 3 further comprising selecting said blocking piece and said connecting piece to reflect part of said oscillation wave and absorb another part of said oscillation wave.

5. The method of volume and tone control according to claim 3 further comprising selecting said blocking piece and said connecting piece to have different weights.

6. The method of volume and tone control according to claim 5 further comprising selecting said blocking piece and said connecting piece to reflect part of said oscillation wave and absorb another part of said oscillation wave.

7. A volume and tonality controller comprising:

a blocking piece having a predetermined thickness and a connection hole;

a spiral staff being connected to said blocking piece through said connection hole and having a metal plate;

a cork being arranged between said blocking piece and said metal plate;

a blocking part being arranged on a side of said blocking piece opposite said cork; and a control cap being arranged on a side of said blocking part opposite said blocking piece.

8. The volume and tonality controller according to claim 7, wherein said a control cap comprises an ornamental area.

9. The volume and tonality controller according to claim 7 wherein said control cap has a screw hole, and said blocking part has a screw attachment configured to fix firmly in said screw hole.

10. A flute comprising:

a mouthpiece;

a head joint; and a volume and tonality controller being arranged inside and to extend from said head joint, said volume and tonality controller comprising, a control cap being attached to a distal end of said head joint, a blocking part being arranged to contact said control cap and being arranged inside said head joint, a blocking piece being arranged on a side of said blocking part opposite said control cap, a cork being arranged on a side of said blocking piece opposite said blocking part, and a screw part having a metal plate arranged on a side of said cork opposite said blocking piece.

11. The flute according to claim 10, wherein said screw part further comprises a spiral staff that is configured to extend through said cork and said blocking piece to contact said blocking part.

12. The flute according to claim 11, wherein said spiral staff has a threaded end that is configured to screw into a threaded hole of said blocking part.

13. The flute according to claim 12, wherein said blocking part further comprises a screw attachment that is configured to be fixed inside a threaded hole of said control cap.

14. The flute according to claim 13, wherein a gap is formed between said blocking part and said blocking piece.

15. The flute according to claim 14, wherein a size of said gap is adjustable.

16. The flute according to claim 10, wherein said blocking part further comprises a screw attachment that is configured to be fixed inside a threaded hole of said control cap.

17. The flute according to claim 16, wherein a gap is formed between said blocking part and said blocking piece.

18. The flute according to claim 17, wherein a size of said gap is adjustable.

* * * * *